United States Patent [19]

Eik

[11] 4,169,338

[45] Oct. 2, 1979

[54] TELESCOPIC BOOM

[75] Inventor: Geir Eik, Ski, Norway

[73] Assignee: A/S NorMar, Oslo, Norway

[21] Appl. No.: 828,663

[22] Filed: Aug. 29, 1977

[30] Foreign Application Priority Data

Sep. 3, 1976 [NO] Norway ..... 763044

[51] Int. Cl.[2] ..... E04H 12/34; B66C 23/06

[52] U.S. Cl. ..... 52/118; 74/25; 212/55; 212/144

[58] Field of Search ..... 74/25; D12/57, 60; 182/2; 212/55, 144; 173/43, 28; 52/117, 731, 116, 121, 632, 115, 118; 214/141

[56] References Cited

U.S. PATENT DOCUMENTS

| | | | |
|---|---|---|---|
| 301,019 | 6/1884 | Teal | 52/118 |
| 1,611,326 | 12/1926 | Abbe | 212/55 |
| 2,896,750 | 7/1959 | Eitel | 52/121 |
| 2,903,949 | 9/1959 | Simmonds | 173/43 |
| 3,097,721 | 7/1963 | Thym | 182/2 |
| 3,319,803 | 5/1967 | Northcott | 212/55 |
| 3,369,670 | 2/1968 | Tourneau | 212/55 |
| 3,722,154 | 3/1973 | Sakamoto | 52/115 |
| 3,749,254 | 7/1973 | Grider | 212/55 |
| 3,800,965 | 4/1974 | Barron et al. | 212/55 |
| 3,807,108 | 4/1974 | Johnston | 52/118 X |
| 3,889,818 | 6/1975 | Wennerstrom | 52/212 |
| 3,913,756 | 10/1975 | Barron et al. | 214/141 |
| 4,004,695 | 1/1977 | Hockensmith et al. | 52/118 X |

FOREIGN PATENT DOCUMENTS

| | | | |
|---|---|---|---|
| 904530 | 7/1972 | Canada | 52/632 |
| 696060 | 12/1930 | France | 214/141 |
| 1183181 | 3/1970 | United Kingdom | 52/118 |

*Primary Examiner*—Leslie Braun

*Attorney, Agent, or Firm*—Watson, Cole, Grindle & Watson

[57] ABSTRACT

A telescopic boom includes three or more sections which may be pivoted if desired. The innermost section is incapable of moving in the longitudinal direction, whereas the other sections are adapted to be concurrently dislocated in the longitudinal direction relative to each other. Only a drive mechanism on the innermost section is adapted to be actuated from an outside source, whereas the other sections are driven by the relative motion of the sections movable in the longitudinal direction.

4 Claims, 4 Drawing Figures

TELESCOPIC BOOM

BACKGROUND OF THE INVENTION

1. Field of the Invention

The present invention relates to a telescopic boom including three or more sections which may be pivoted if desired, and of which the innermost section is constituted by a housing which is incapable of moving in the longitudinal direction, whereas the other sections are adapted to be concurrently dislocated in the longitudinal direction relative to the respective adjacent sections located inwardly thereof, when the boom is to be lengthened or shortened.

2. Description of the Prior Art

In known telescopic booms hydraulic cylinders are mostly used for the extension and retraction of the boom. For each telescope section there may then be used a cylinder housed in its own telescope section, or a cylinder common to all of the telescope sections may be used.

Due to the different effective cylinder area during extension or retraction of the cylinder section, respectively, such known telescopic booms suffer from the disadvantage that the pushing force and the pulling force are not equal. Besides, when using hydraulic cylinders, sealing problems will occur due to wear of the guiding portions.

SUMMARY OF THE INVENTION

The task underlying the present invention is to arrive at a telescopic boom which is not encumbered with the above mentioned disadvantages. According to the invention, in a telescopic boom of the type mentioned in the preamble, this task is fulfilled due to the fact that for dislocating each of the sections movable in the longitudinal direction, a mechanical drive mechanism is provided which is located on the adjacent section located inwardly thereof and that only the drive mechanism on the innermost section, which is not movable in the longitudinal direction, is adapted to be supplied with energy from an outside source, the actuation of each of the other drive mechanisms being accomplished by a drive means mounted on the same section as the associated drive mechanism and is in engagement with the adjacent section located inwardly thereof, so as to be driven by the relative motion of this section and the section on which the drive means is mounted.

Hereby a telescopic boom is achieved which affords a uniform pushing force outwardly and the same pulling force inwardly and, at the same time, there are obtained telescopic booms which with the same constructional dimensions, have a larger capacity compared with known telescopic booms driven by hydraulics.

The invention will in the following be described in further detail, reference being had to the drawings which illustrate preferred embodiments of the structure according to the invention.

DESCRIPTION OF PREFERRED EMBODIMENTS

Telescopic booms of the type which will be discussed in the following, find application, for example, on drilling platforms in connection with the handling of sections of drilling pipes and lining pipes or units comprising a plurality of such sections. The telescopic boom is usually located in the area of the turntable of the drilling string in which it is pivotally mounted on a suitable base. At the free end of the outermost telescope section, the telescopic boom is provided with a gripping head serving to grip around the pipe units for handling same. By means of the telescopic boom, the pipe units may be moved to or from the area of the turntable by a suitable change of length and swinging of the boom.

Figure 1:
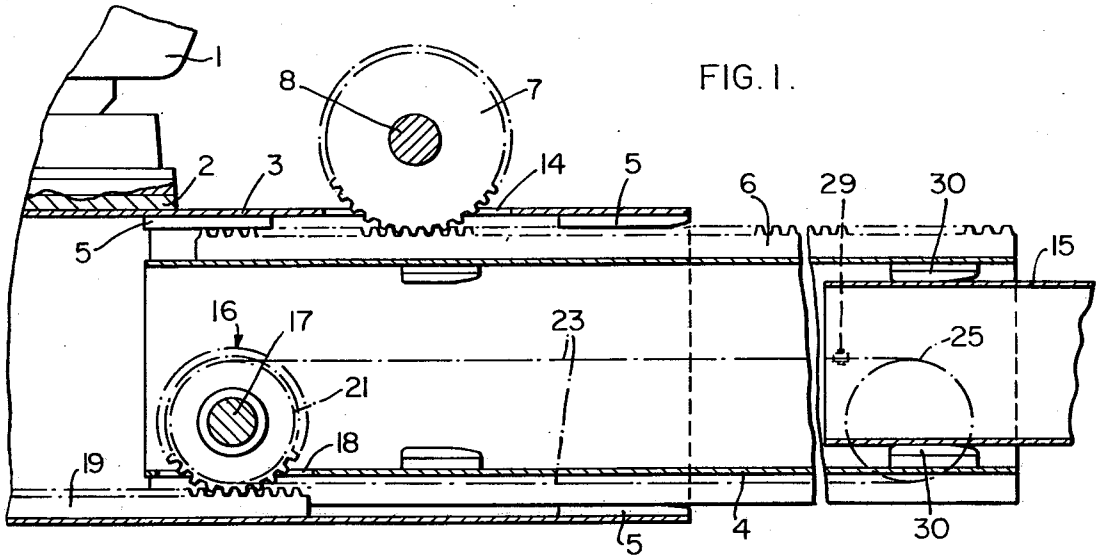
FIG. 1 is a side view, partly in section, of a telescopic boom according to the invention comprising two boom sections.
Figure 2:
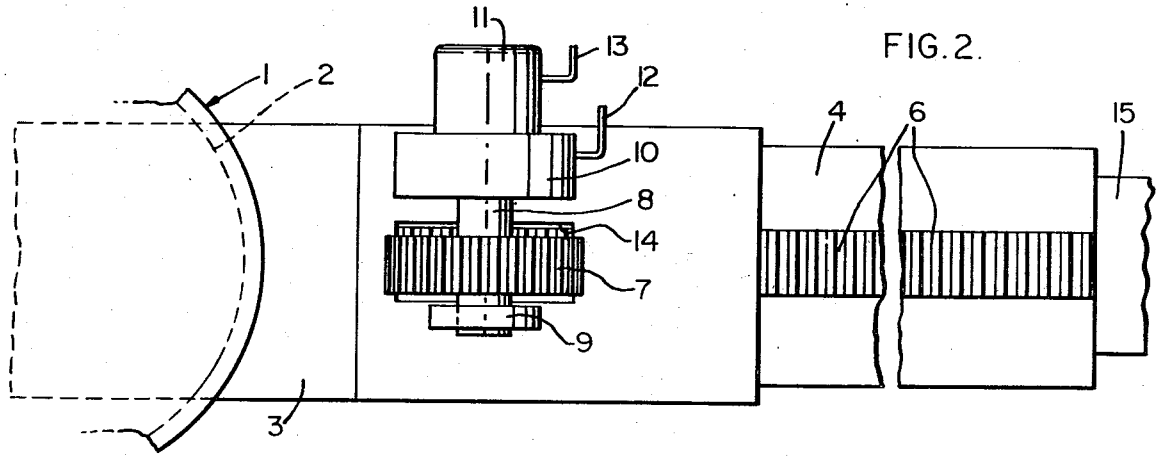
FIG. 2 is a view of the telescopic boom of FIG. 1 as seen from above.
Figure 3:
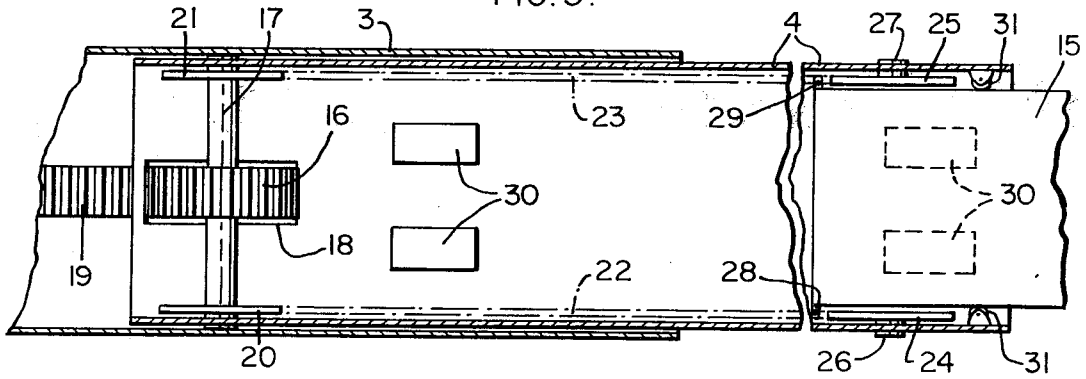
FIG. 3 is a horizontal sectional view through the telescopic boom of FIG. 1, but wherein the outermost boom section is not shown in section.

In FIGS. 1–3, which depict details of a telescopic boom designed according to the present invention and comprising two boom sections, 1 designates a substantially round base unit housing driving means for rotating an annular rotating disk 2. 3 designates a telescope housing which is affixed to the rotating disk 2 and which can be swung horizontally together with the rotating disk 2. If desired, the base unit may take such a form that a hoisting and lowering motion may be imparted to the telescope housing 3.

In the housing 3, which is constructed substantially as a rectangular pipe, there is provided a first telescope or boom section 4 of substantially the same shape as the telescope housing 3, i.e. having four walls which define a substantially rectangular hollow pipe, but having dimensions which permit it to travel out of and into the housing 3 with a suitable play. The boom section 4 is supported on a plurality of sliding or guiding pieces 5 attached to the inner walls of the housing. On the outside of the upper wall the section 4 carries a longitudinal rack 6, which is in engagement with a drive gear wheel 7 mounted on the outside of the housing 3. The shaft 8 of the gear wheel is supported at its free end in a bearing 9 and is at the driving end connected to a hydraulic coupling means 10 driven by a hydraulic motor 11. The coupling means 10 and the hydraulic motor 11 receive hydraulic pressure transferred from an oil supply (not shown) via pipes 12 and 13, respectively. The part of the gear wheel 7 engaging the rack 6 on the section 4 protrudes through an opening 14 in the upper part of the housing.

During operation of the motor 11 the boom section 4 will, dependent on the direction of rotation of the motor, be passed out of the housing 3 or pulled into it. Concurrently with the movement of the boom section 4 also another boom section 15, which is provided in the section 4, will move relative thereto in a manner which will be more fully discussed in the following.

The movement of the second boom section 15 relative to the section 4 is primarily brought about by means of a gear wheel 16 which with its shaft 17 is pivotally supported at the inner end of the section 4. A portion of the gear wheel 16 protrudes through an opening 18 in the section 4 and is in engagement with a longitudinally moving rack 19 provided on the inside of the bottom portion of the housing 3. At each end of the shaft 17 there is affixed a sprocket wheel 20 and 21, respectively. Two chains 22 and 23, respectively, are passed around individual sprocket wheels 20 and 21, respectively, and further around individual sprocket wheels 24 and 25, respectively, which are rotatably mounted on the inside of the outer end of the section 4. In FIG. 3 the bearings of the sprocket wheels 24 and 25 are indicated at 26 and 27, respectively.

The chains 22 and 23 are connected to the boom section 15 by means of attachment means 28 and 29, respectively. When the gear wheel 16 engaging the rack 19 is rotating due to relative movement of the section 4 and the housing 3 consequent to the gear wheel 7 being driven, the chains 22 and 23 will dislocate the section 15 relative to the section 4, so as to impart a telescopic extension or retraction to the boom.

In a similar manner as the section 4, the section 15 is supported by sliding or guiding pieces 30 provided on the inside of the section 4. At the outer end of the section 4 there are also provided sliding or guiding rollers bearing on the section 15.

Figure 4:
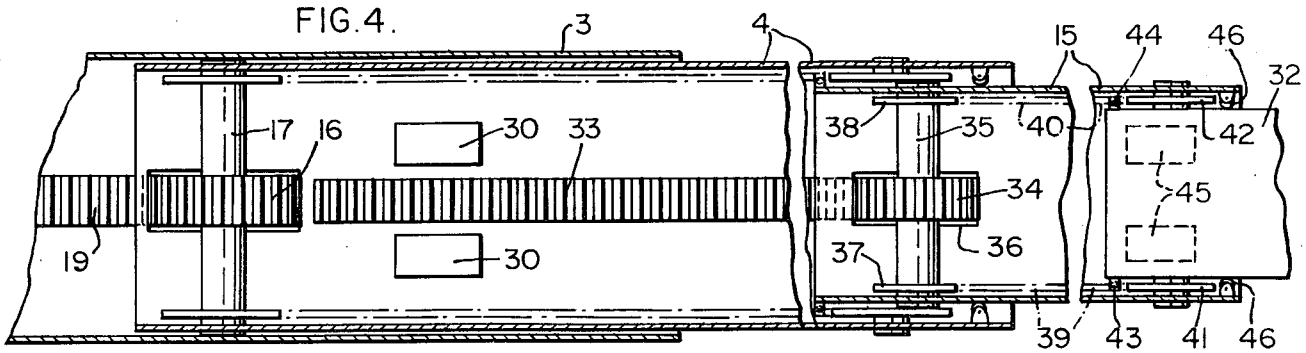
FIG. 4 is a sectional view similar to FIG. 3 of a telescopic boom according to the invention having an additional boom section.

FIG. 4 is a sectional view of a telescopic boom which includes an additional telescope or boom section 32. The view, according to FIG. 4 corresponds to a section taken along the line IV—IV in FIG. 1, and as regards the parts which are illustrated in connection with FIG. 3 and which are repeated in FIG. 4, the same reference numerals are assigned thereto. Thus, also here 3 designates the housing, 4 the first boom section, 15 the second boom section etc.

In the boom section 4 shown in FIG. 4, in addition to the parts already included beforehand, there is provided a longitudinal rack 33 which extends from the area of the gear wheel 16 to the front end of the section. A gear wheel 34, which with its shaft 35 is rotatably mounted in the inner end of the boom section, is in engagement with the rack 3. A portion of the gear wheel 34 protrudes through an opening 36 in the lower portion of the section 15, and at each end of the shaft 35 of the gear wheel there is mounted a sprocket wheel 37 and 38, respectively. Around each sprocket wheel 37 and 38, respectively, there is passed a chain 39 and 40, respectively, the chain 39 being further passed around a sprocket wheel 41 provided at the outer end of the section 15 and the chain 40 being passed around a second sprocket wheel 42 which is placed oppositely of the wheel 41 at the outer end of the section 15.

The chains 39 and 40 are connected to the section 32 by attachment means 43 and 44, respectively. When the gear wheel 34 which is in engagement with the rack 33, is rotating due to the relative motion of sections 15 and 4, as explained above in connection with FIGS. 1 to 3, the chains 39 and 40 will dislocate section 32 relative to section 15 for so as to give the boom an additional telescopic extension or retraction.

In a similar manner as the sections 4 and 15, the section 32 is supported by sliding and guiding pieces 45 provided on the inside of the section 15. Also in the embodiment of FIG. 4, at the outer end of the section 15, there is provided sliding and guiding rollers 46 bearing against the section 32 and serving for a further stabilization of the same when it is in the fully extended position.

It is to be understood that the telescopic booms described above can be expanded to comprise more than three boom sections depending on the application for which the boom is calculated. It is also to be understood that the mechanical power transmission from boom section to boom section can be effected in various manners without departing from the scope of the invention.

For example, the chains for driving a first boom section may be so adapted that they transfer their movement to a shaft mounted in another boom section which is moved relative to the first. On the said shaft of the second section there may then be provided a gear wheel which engages a rack on the first section. During movement of the chains the gear wheel will then rotate, but as it concurrently engages the said rack, the rotating movement will be transferred into a linear motion for the second section.

It is further to be understood that the embodiments described above can also be combined with boom sections which are displaced in a boom section located outside thereof by means of hydraulic cylinders. Such a combination may be advantageous when a gripping head, which also works with hydraulic pressure, is mounted at the end of the outermost boom section.

What is claimed is:

1. A telescopic structure comprising a plurality of elongated slidably fitted concentric tubular sections including:

(a) a first tubular housing section having at the outer surface of its one end a drive mechanism comprising a first gear wheel mounted for rotation about a fixed axis on said housing section and protruding through a slot formed therein, said first housing further having a first gear rack extending longitudinally along its internal surface;

(b) a second tubular section having an outside dimension smaller than the first housing section and having a second gear rack formed on its external surface for engagement with the first gear wheel mounted on and protruding through the housing section, whereby on rotation of said first gear wheel said second section is moved longitudinally relative to said tubular housing section;

said second section further comprising longitudinally spaced first sprocket wheels mounted for rotation adjacent opposite ends of said second section, an endless first chain extending about said sprocket wheels for moving thereby, a first pair of said first sprocket wheels being mounted for rotation on a transversely extending shaft carrying a second gear wheel which protrudes through an opening in said second section for engagement with the first gear rack on the internal surface of said housing section;

whereby on longitudinal movement of said second section caused by the rotation of said first gear wheel of said housing section, said second gear wheel will rotate to impart a movement to the endless first chain;

(c) a third section having an outside dimension smaller than the second section and means for engaging the endless first chain of the second section so as to be moved longitudinally relative to said second section upon movement of said first chain when said second section is caused to move by the rotation of said first gear wheel on the housing section.

2. The arrangement according to claim 1, wherein said first endless chain is directly connected to said third section for moving same upon movement of said chain.

3. The arrangement according to claim 1, wherein said second section includes a further gear wheel mounted for rotation upon movement of the first endless chain of said second section, and wherein said third section comprises a longitudinally extending second rack mounted in engagement with said further gear wheel of said second section further so as to be driven upon rotation thereof.

4. The arrangement according to claim 1, further including a fourth section telescoped with said third section and being mounted for concurrent longitudinal movement relative to said third section for extending and retracting the boom, a mechanical drive mechanism for effecting the movement of said fourth section includes a third gear wheel mounted for rotation about a fixed axis on said third section, a third longitudinally extending rack mounted on said second section in engagement with said third wheel, a pair of longitudinally spaced second sprocket wheels mounted for rotation adjacent opposite ends of said third section, a second endless chain extending about said second sprocket wheels, one of said second sprocket wheels being coupled with said third gear so as to be driven upon rotation thereof as said third section is moved longitudinally relative to said second section upon movement of said first chain when said second section is caused to move by the rotation of said first gear wheel on the housing section, and said second chain engaging said fourth section for moving same upon movement of said second chain during rotation of said third gear.

* * * * *